US005842542A

United States Patent [19]

Tien

[11] Patent Number: 5,842,542

[45] Date of Patent: Dec. 1, 1998

[54] SINGLE ROPE DESCENDING DEVICE

[76] Inventor: Feng-Yi Tien, 5-2F, No. 25, Lane 66, Chai Pei ST., Chai-I City, Taiwan

[21] Appl. No.: 941,074

[22] Filed: Sep. 30, 1997

[51] Int. Cl.[6] ..... A62B 1/08

[52] U.S. Cl. ..... 182/231; 182/240; 182/71; 182/72; 182/236; 182/235; 182/6

[58] Field of Search ..... 182/231, 236, 182/235, 240, 71, 72, 6; 188/65.4, 65.5

[56] References Cited

U.S. PATENT DOCUMENTS

| | | |
|---|---|---|
| 514,802 | 2/1894 | Wood . |
| 539,958 | 5/1895 | Madden . |
| 797,903 | 8/1905 | Meadens . |
| 859,266 | 7/1907 | Ulery . |
| 1,198,926 | 9/1916 | Kemp . |

*Primary Examiner*—Alvin C. Chin-Shue
*Attorney, Agent, or Firm*—A & J

[57] ABSTRACT

A single rope descending device, especially a portable descending device for use of a single person, comprises a receiving housing, a cap, an adjusting nut, and a rope windlass. The receiving housing is made up of a left and a right semi-circular hollow halves within which the rope windlass having a rope wound and raveled thereon is housed. Each half of the receiving housing is provided with a tapered protruding end wherein corresponding serrated clamping edges define the assembling part thereof to boost up the resistant force of the rope passed through the twist and turn formed thereby. The cap is screwed up to conic outer threads of the tapered protruding ends to clamp tight the tapered protruding ends against the rope. An adjusting rod screwed up to one peripheral surface of the cap can be swung which in turn will activate the movement of the cap so as to regulate the clamping force of the tapered protruding ends against the rope so that the descending device can be descended safely and smoothly at a regular speed. In addition, the serrated clamping edges of the tapered protruding ends can also be made into straight edges so as to simplify the production of the serrated clamping edges thereof.

2 Claims, 6 Drawing Sheets

SINGLE ROPE DESCENDING DEVICE

BACKGROUND OF THE INVENTION

The present invention is related to a single rope descending device, especially to a portable descending device for use of a single person having a receiving housing, a cap, an adjusting nut, and a rope windlass. The receiving housing is made up of a left and a right semi-circular hollow halves within which the rope windlass having a rope wound and raveled thereon is housed. Each half of the receiving housing is provided with a tapered protruding end wherein corresponding serrated clamping edges are disposed so as to strengthen than resistant force of the rope passed through the twist and turn formed by the combined tapered protruding ends thereof. The cap is screwed up to conic outer threads of the tapered protruding ends to clamp tight the tapered protruding ends against the rope. An adjusting rod is adapted to the cap at one peripheral surface to regulate the clamping force thereof so that the descending device can be descended safely and smoothly at a regular speed Nowadays, tall buildings or skyscrapers define a common landscape of a modern city. In case of emergency such as fire, equipment for escaping from a higher ground become indispensable. All kinds of descending devices are thus available on the market. Yet, there are several drawbacks inherent in a conventional descending device. First, mostly a descending device belongs to a common wealth shared by the inhabitants of the same building. For the convenience of public use, the descending device is installed in a fixed location. This, however, may become its malfunction because the site of emergency such as fire may occur at any places including where the descending device is fixed. Thus, the inhabitants may lose their chance of escape. Second, due to its use for the public, a conventional descending device is made to suit the weight of the general people. For ones overweight like fat people or underweight like children, they may lose their timing in escaping because the descending speed tends to become too fast or too slow due to their weight. Furthermore, in descending, the user must descend with their hands open wide without touching the rope. It is very horrible and scaring.

SUMMARY OF THE PRESENT INVENTION

It is therefore the primary object of the present invention to provide a single rope descending device, especially to a portable descending device for use of a single person, which can be easily carried in a luggage case and can be quickly installed for use in case of emergency.

It is a second object of the present invention to provide a single rope descending device having a receiving housing, a cap, an adjusting nut, and a rope windlass wherein the receiving housing is made up of a left and a right semi-circular hollow halves within which the rope windlass having a rope wound and raveled thereon is housed. The cap is applied to clamp tight tapered protruding ends of the receiving housing against the rope, while the resistant force of the rope is reinforced via corresponding serrated clamping edges of the tapered protruding ends thereof. An adjusting rod is flier adapted to the cap to regulate the clamping force thereof so that the descending device can be descended safely and smoothly at a regular speed.

BRIEF DESCRIPTION OF THE DRAWINGS

FIG. 1A is a partially enlarged view showing the adjusting rod of the present invention.

FIG. 1B is a partially enlarged view showing the post engaged with the adjusting rod of the present invention.

DETAILED DESCRIPTION OF THE PREFERRED EMBODIMENTS

Figure 1:
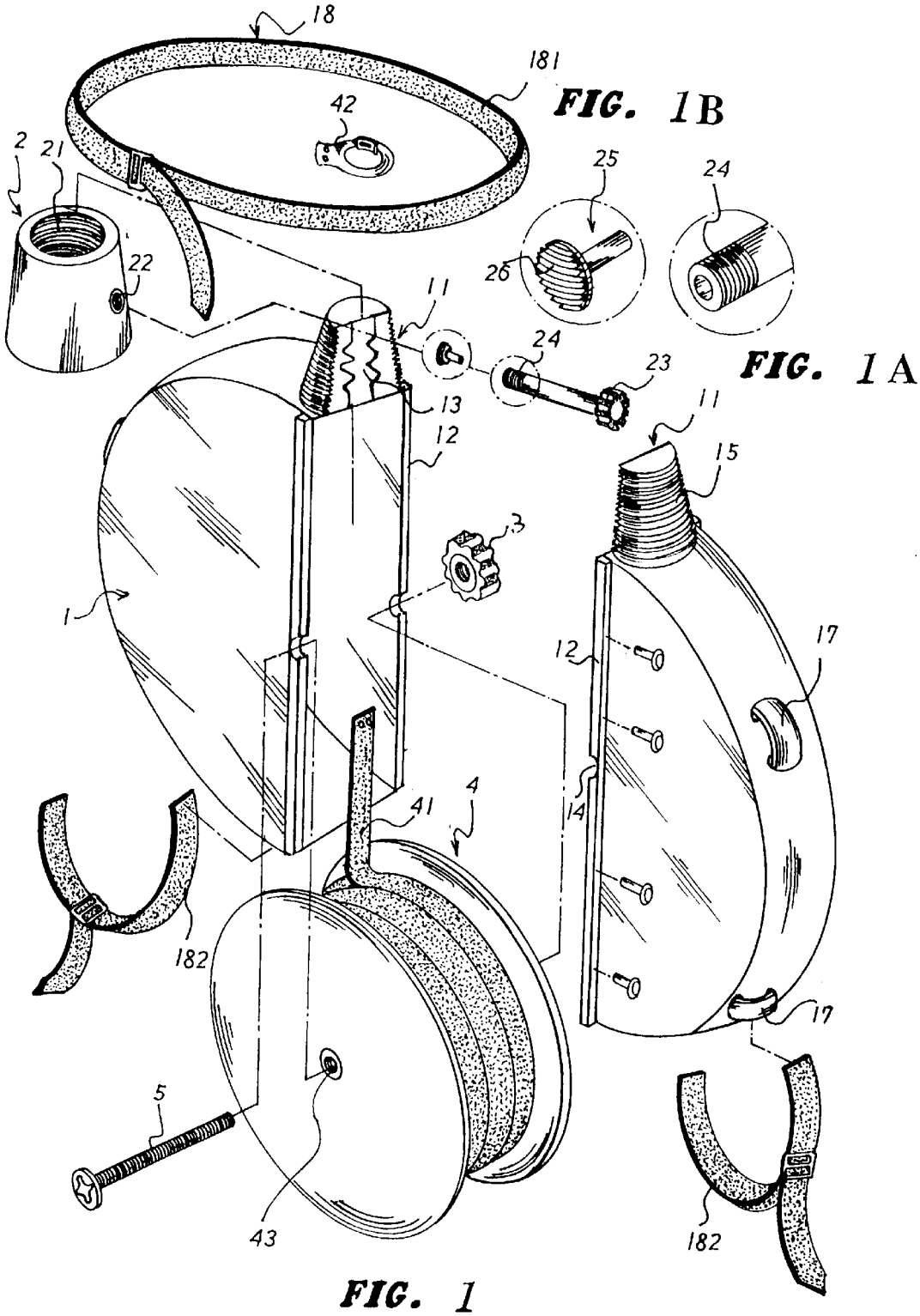
FIG. 1 is a perspective exploded view of the present invention.

Please refer to FIG. 1. The present invention is related to a single rope descending device, especially to a portable descending device for use of a single person, comprising a receiving housing 1, a cap 2, an adjusting nut 3, and a rope windlass 4.

The receiving housing 1 is made up of a left and a right semi-circular hollow halves, each having a tapered protruding end 11 disposed at the top, thick protruding flange 12 defining the connecting edges by which the left and right halves are combined into one whole piece via rivets, and multiple protruding ears 17 disposed at the outer periphery thereof, permitting multiple straps 18 to be passed therethrough. Each tapered protruding end 11 is provided with serrated clamping edges 13 corresponding to that of the other half, while the multiple straps 18 led through the multiple protruding ears 17 are made into a chest belt 181 and two crotch belts 182 respectively. In addition, the tapered protruding end 11 is equipped with conic outer threads 15, and a pivot through hole 14 is disposed at the center point of the receiving housing 1.

The interior of the cap 2 is provided with conic inner threads 21; and one peripheral side of the cap 2 is disposed with a screw hole 22. An adjusting rod 23 is adapted to be led through and secured to said screw hole 22 at one end via outer threads 24 disposed at the end thereof as shown in FIG. 1A. The top end of the outer threads 24 thereof is further pivotally jointed to a post 25 having a thread plane 26 disposed at top end as shown in FIG. 1B.

The adjusting nut 3 is a butterfly nut body.

The rope windlass 4 is provided with a shaft hole 43 at the center point wherein a rope 41 engaged with a hook 42 at one end can be wound and raveled around the rope windlass 4 thereof.

Figure 2:
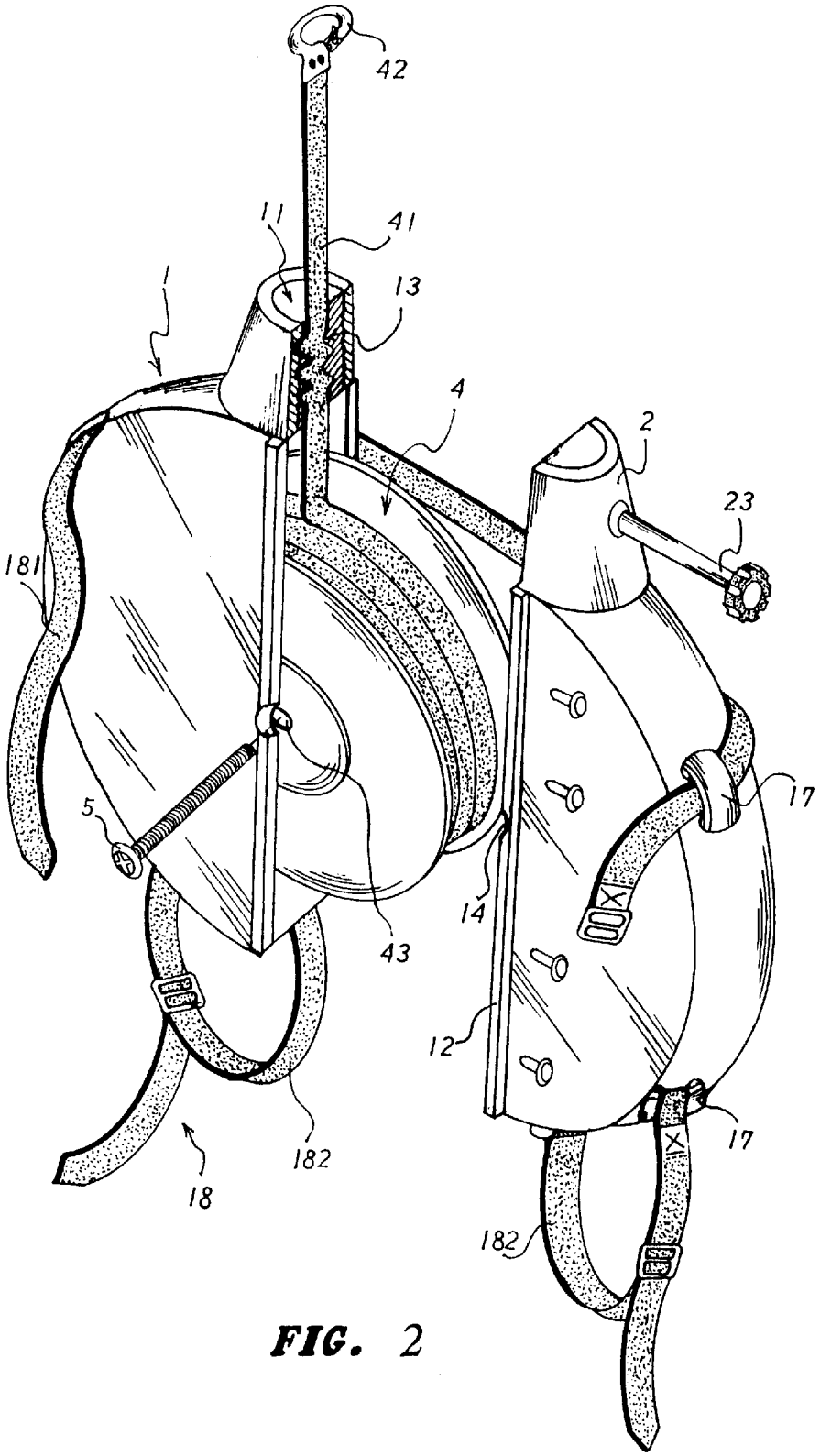
FIG. 2 is a perspective view showing the present invention in assembly.
Figure 3:
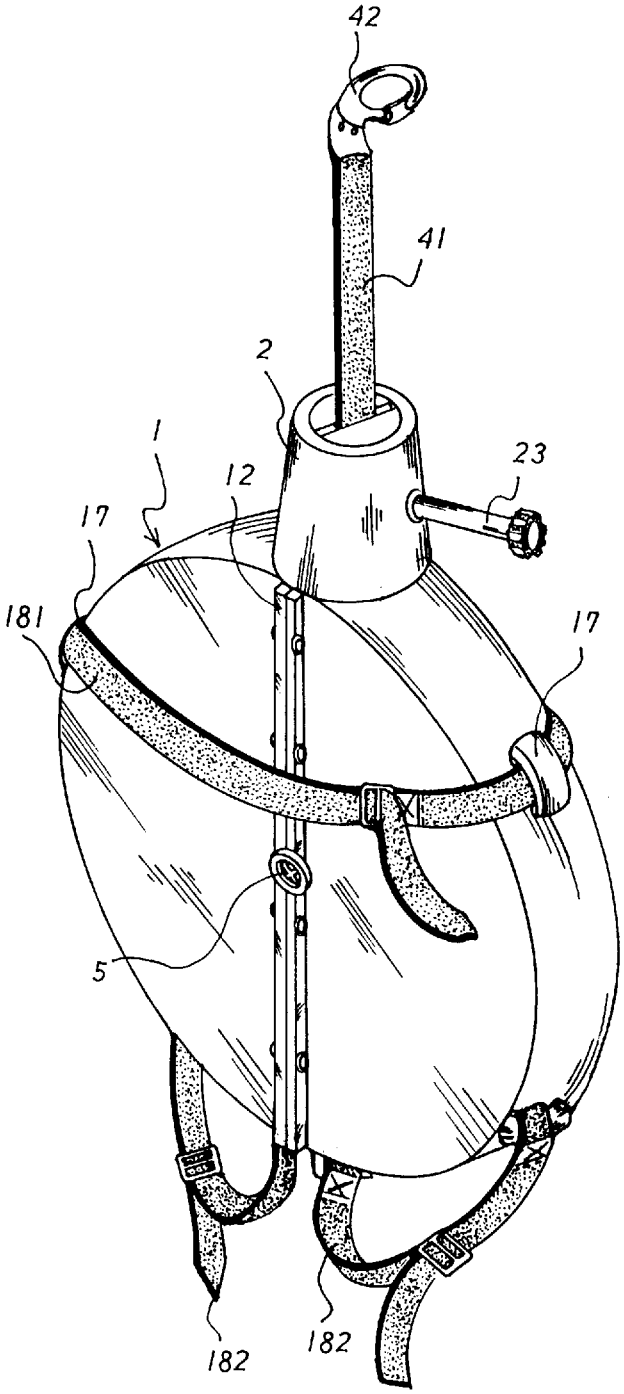
FIG. 3 is a perspective assembled view of the present invention.

Please refer to FIG. 2. In assembly, a bolt 5 is adapted to be led through the shaft hole 43 disposed at the center point of the rope windlass 4. The left and right semi-circular hollow halves of the receiving housing 1 are then correspondingly closed up and assembled into one piece via rivets passing through the thick protruding flanges 12 thereof, having the rope windlass 4 received therewithin the hollow space formed by the assembled halves and the bolt 5 abutted against the pivot through hole 14 thereof. One end of the rope 41 is led through the interior of the combined tapered protruding ends 11, passing through the twist and turn defined by the corresponding serrated clamping edges 13 thereof and coming out of the tapered protruding ends 11 with one end engaged with the hook 42. Finally, the cap 2 is screwed up to the conic outer threads 15 of the two combined halves of the tapered protruding ends 11 thereof via inner threads 21 to complete the assembly of the present invention as shown in FIG. 3.

In practical use, the adjusting nut 3 screwed up first against the bolt 5 reinforces the clamping force of the bolt 5 abutting against the pivoting holes 14 of the receiving housing 1 thereof, and thus the resistant force of the rope windlass 4 in the operation of unraveling the rope 41. In addition, the cap 2 attached to the tapered protruding ends 11 thereof via inner threads 21 screwed up to the conic outer threads 15 thereof boosts the clamping force of the tapered protruding flanges 11 against the rope 41. Finally, the adjusting rod 23 works like a handle, being further adapted to the assembled tapered protruding ends 11 and the cap 2 so as to regulate the clamping force of the tapered protruding ends against the rope 41 in descending operation. Consequently, in the mechanism above, the more resistant force the rope descending device is adjusted into, the slower the descending movement will become.

Figure 4B:
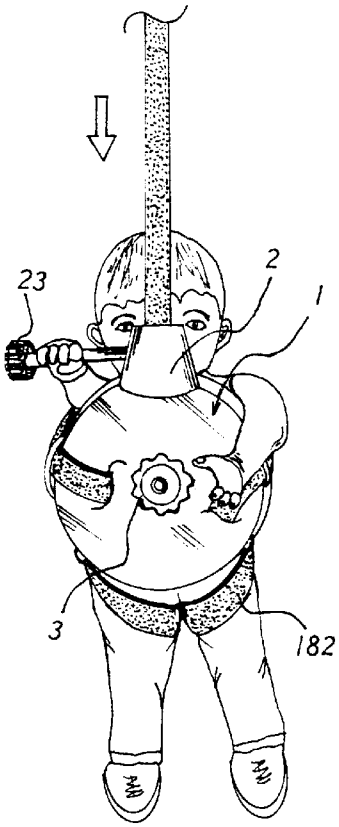
FIG. 4B is another view showing the embodiment of the present invention in operation
Figure 4A:
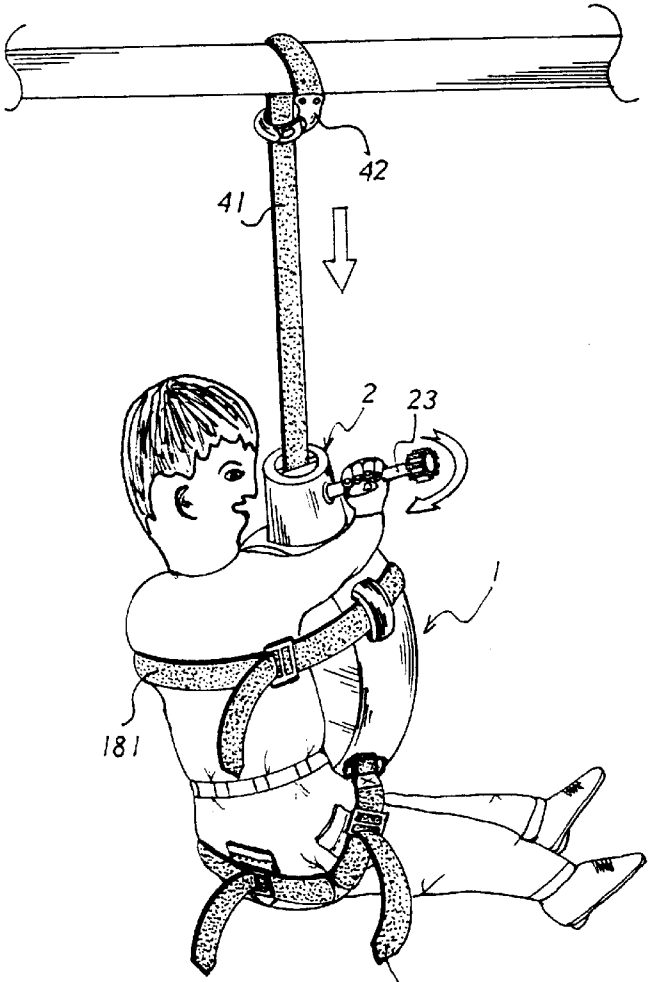
FIG. 4A is one view showing the embodiment of the present invention in operation.
Figure 5B:
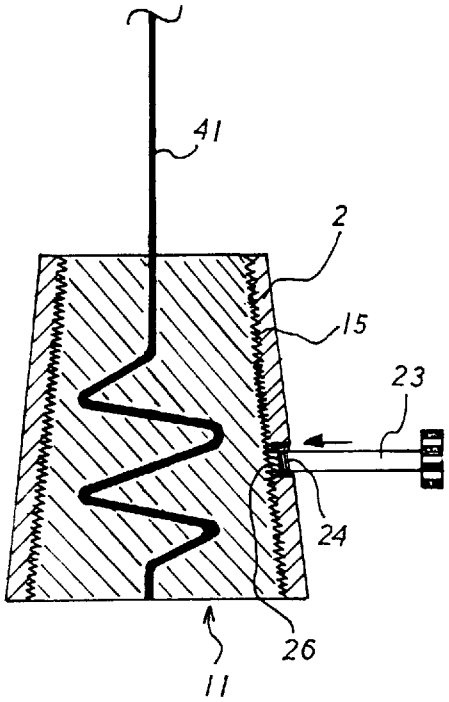
FIG. 5B is a cross sectional view showing the screwed-up of the adjusting rod after the adjustment of the present invention.
Figure 5A:
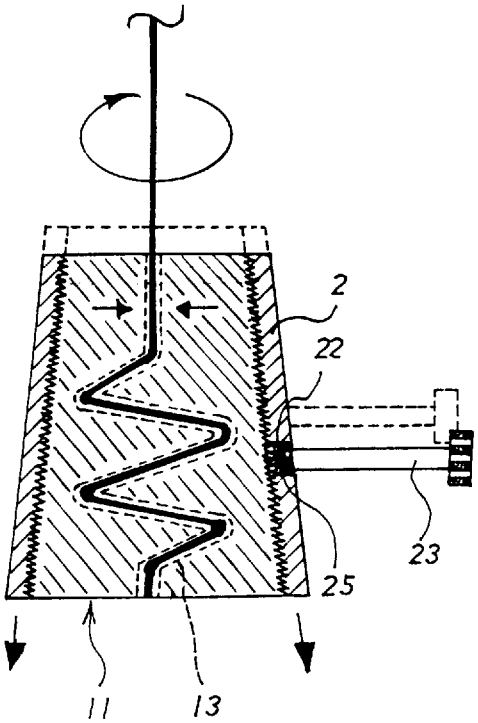
FIG. 5A is a cross sectional view showing the adjustment of the cap via the adjusting rod of the present invention.

Please refer to FIGS. 4A–B. In case of emergency, a user first applies the chest belt 181 around the chest and then has the two crotch belts 182 led through one's legs to rest at the crotches. The rope 41 is then fastened to any post or fixing object by one end via the hook 42 attached to that end of the rope 41. The adjusting rod 23 can be swung to activate the movement of the cap 2 which in turn will regulate the clamping force of the tapered protruding ends 11 against the rope 41 so as to control the speed of the unraveling of the rope 41 in descending operation as shown in FIG. 5A. When a proper speed is reached, the adjusting rod 23 is further screwed up against the screw hole 22 of the cap 2 till the thread plane 26 disposed at the post 25 of the adjusting rod 23 is abutted closely against conic outer threads 15 of the tapered protruding ends 11 thereof as shown in FIG. 5B. With the thread plane 26 matched thereto, the conic outer threads 15 of the tapered protruding ends 11 will not be worn out of use in the repeated screwed up or loosening of the adjusting rod 23. Thus, in the descending movement, the rope 41 can be unraveled smoothly and regularly. The user can safely hold on to the outer carcasses of the receiving housing 1 and descend quickly to the safe ground at a regular speed. Once landed, the user can easily retrieve the chest belt 181 and the crotch belts 182 immediately to escape from danger.

Figure 6:
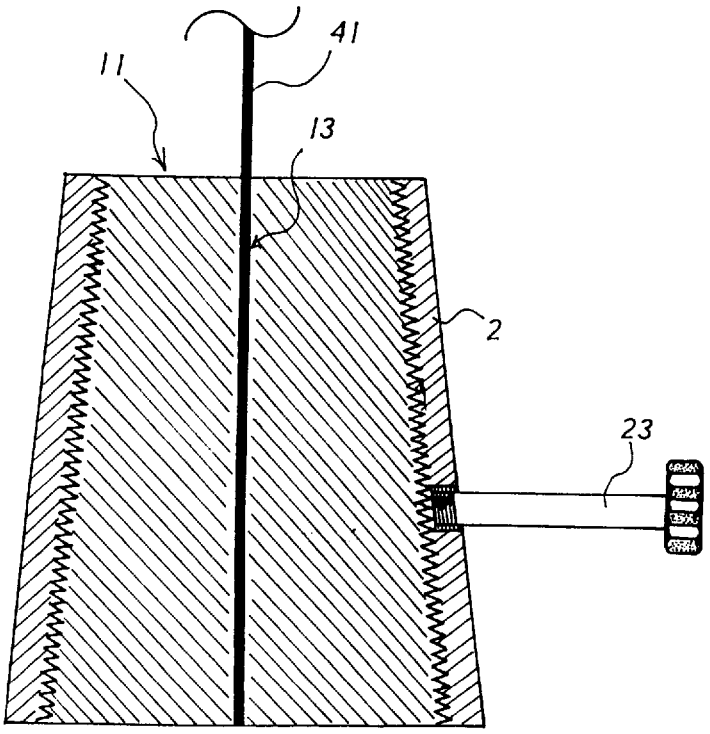
FIG. 6 is a cross sectional view showing another embodiment of the clamping edges of the tapered protruding ends thereof of the present invention.

Please refer to FIG. 6. To simplify the production of the serrated clamping edges 13 of the protruding ends 11, the clamping edges 13 of the protruding ends 11 can also be made into straight edges.

What is claimed is:

1. A single rope descending device, especially for use by a single person, comprising an adjusting nut, a rope windlass, a receiving housing, and a cap, wherein the adjusting nut is a butterfly nut body;

the rope windlass is provided with a shaft hole at it's center point and a rope having a hook attached at one end is wound around the windlass;

the receiving housing is made up of a left and a right semi-circular hollow halves, each having a tapered protruding end disposed at the top, thick protruding flange defining connecting edges by which said left and right halves are combined into one whole piece via rivets, and multiple protruding ears disposed at the outer periphery thereof, and having multiple straps passed therethrough; each tapered protruding end having inner clamping edges corresponding to that of the other half, the multiple straps led through the multiple protruding ears being made into a chest belt and two crotch belts; in addition, said tapered protruding end being equipped with conic outer threads, and a pivot through hole being disposed at the center point of said receiving housing;

the interior of the cap is equipped with conic inner threads, and one peripheral side of the cap having a screw hole; an adjusting rod being adapted to be led through and secured to said screw hole at one end via outer threads disposed at the end thereof; end of said rod being further pivotally jointed to a post having a thread plane disposed at an end thereof; a bolt is adapted to be led through said shaft hole disposed at the center point of said rope windlass; said rope windlass received within the hollow space formed by the receiving housing and said bolt abutted against said pivot through hole with said adjusting nut threaded thereon; one end of said rope being led through the interior of the combined tapered protruding ends, passing through the clamping edges and coming out of said tapered protruding ends with one end engaged with said hook; said cap being screwed unto said conic outer threads of the two combined halves of said tapered protruding ends thereof via the inner threads to clamp tight said protruding ends against said rope, reinforcing the resistant force on said rope, said adjusting rod can be swung to activate movement of said cap which in turn will regulate the clamping force of said protruding ends against said rope so as to control the descent of said rope descending device.

2. The single rope descending device as claimed in claim 1 wherein said clamping edges of said protruding ends are serrated.

* * * * *